US005717661A

United States Patent [19]

Poulson

[11] Patent Number: 5,717,661

[45] Date of Patent: Feb. 10, 1998

[54] METHOD AND APPARATUS FOR ADJUSTING THE ACCURACY OF ELECTRONIC TIMEPIECES

[76] Inventor: T. Earl Poulson, 22 Elmwood Dr., Indian Head Park, Ill. 60525

[21] Appl. No.: 359,483

[22] Filed: Dec. 20, 1994

[51] Int. Cl.[6] ..... G04B 17/20

[52] U.S. Cl. ..... 368/202; 368/200

[58] Field of Search ..... 368/10, 180–203

[56] References Cited

U.S. PATENT DOCUMENTS

| | | | |
|---|---|---|---|
| 3,948,036 | 4/1976 | Morokawa | 58/23 R |
| 4,134,254 | 1/1979 | Yasukura | 368/187 |
| 4,154,053 | 5/1979 | Chetelat et al. | 58/23 |
| 4,155,218 | 5/1979 | Wiget | 368/69 |
| 4,378,167 | 3/1983 | Aizawa | 368/201 |
| 4,407,589 | 10/1983 | Davidson et al. | 368/201 |
| 4,408,897 | 10/1983 | Mutrux | 368/200 |
| 4,903,251 | 2/1990 | Chapman | 368/156 |
| 5,274,545 | 12/1993 | Allan et al. | 368/156 |
| 5,375,105 | 12/1994 | Borowski | 368/200 |

FOREIGN PATENT DOCUMENTS

| | | |
|---|---|---|
| 1524059 | 9/1978 | United Kingdom . |
| 1533104 | 11/1978 | United Kingdom . |
| 1556273 | 11/1979 | United Kingdom . |
| 1570897 | 7/1980 | United Kingdom . |

*Primary Examiner*—Bernard Roskoski
*Attorney, Agent, or Firm*—Jenner & Block

[57] ABSTRACT

A method and apparatus for adjusting the accuracy of an electronic timepiece that includes an oscillator with a $2^n$ frequency output, means for reducing the oscillator output frequency to a time keeping frequency, means for counting the time keeping frequency, and means for displaying the time corresponding to the count of the time keeping frequency. The timepiece is initially synchronized with a time standard. After a period of time has elapsed, the timepiece is resynchronized with a time standard and the error E accumulated by the timepiece since the previous synchronization is calculated. The accumulated error, E, is divided by the number of adjustment intervals elapsed since the previous synchronizing of the timepiece, N, to obtain an accuracy adjustment factor. Then, at a specified time interval during each subsequent adjustment interval, the timekeeping frequency is adjusted by the amount of the accuracy adjustment factor to produce a resultant adjustment interval which equals an ideal time period. Thus, the cumulative accuracy of the timepiece is maintained over the life of the timepiece.

15 Claims, 2 Drawing Sheets

METHOD AND APPARATUS FOR ADJUSTING THE ACCURACY OF ELECTRONIC TIMEPIECES

BACKGROUND OF THE INVENTION

1. Field of the Invention

The present invention relates generally to electronic timepieces, and more specifically concerns a method and apparatus for adjusting the accuracy of electronic timepieces.

2. Background

In electronic timepieces, an oscillator output frequency is provided by a quartz crystal whose frequency of resonance must be very accurately adjusted at the time of manufacture. Initial adjustment of the operating frequency of a quartz crystal entails expensive mechanical techniques to more accurately grind the crystal. Moreover, a variable capacitor is required in the oscillator to allow for future adjustments of the operating frequency in order to compensate for variations caused by the drift of the quartz crystal. The aging of the crystal, temperature variations, and, in the case of wristwatches, wearing habits of the user, may all contribute to the drift of the quartz crystal.

To avoid the need for expensive adjustments of the operating frequency of the quartz crystal, several systems have been suggested which allow the use of quartz crystals whose operating frequencies deviate slightly from an ideal frequency.

Generally, such systems include an adjusting circuit coupled with memory containing binary information corresponding to the value of the adjustment to be made. The manufacturer of the timepiece determines the binary information and places it in the memory at the time of manufacture. The adjusting circuit uses the information provided by the memory to synchronize the time keeping frequency so it matches a time standard. Such systems reduce the need for costly initial adjustments of the quartz crystal, but fail to provide means for compensating for the future drift of the quartz crystal.

Consequently, systems have been developed which allow the user of an electronic timepiece to modify the value of the adjustment contained in the memory. These systems operate by determining the error of the timepiece, as compared to a reference time, which has accrued over some time period. Using the error and the corresponding time period over which it accrued, such systems calculate a correction value for the adjustment factor and add it to the adjustment factor to obtain a new adjustment factor.

Invariably, these systems apply the adjustment factor so as to modify each second of the time keeping frequency. This method of correcting the operating frequency of a quartz crystal by adjusting the time keeping frequency each second has an inherent limitation. By adjusting the time keeping frequency each second, existing systems necessarily limit the degree of precision the user may achieve with the timepiece. Due to their limited precision, existing systems are often unable to accurately compensate for the cumulative error of the timepiece. The result is that, despite correcting adjustments, the timepiece remains slightly slow or fast.

For example, consider a typical quartz oscillator that operates at a frequency of $2^{15}$ Hertz. Existing systems that correct the time keeping frequency of a timepiece every second are capable of adjusting the frequency up to a precision of 1 part in 32,768 or $3.05\times10^{-5}$ seconds per second. Adjusting each second by $3.05\times10^{-5}$ seconds translates into an adjustment of 2.64 seconds per day. Thus, the smallest modification possible with existing systems is 2.64 seconds per day. If the error of a timepiece is less than 2.64 seconds per day, existing systems are incapable of accurately correcting the frequency.

However, if a system could adjust the time keeping frequency once every adjustment interval, where the adjustment interval was a period of time greater than a second, the system could achieve proportionally greater precision. For instance, if the system adjusted the time keeping frequency of one second every hour rather than the frequency of each and every second, an improvement in the precision of the timepiece on the order of 3600 would be realized. The system would be able to adjust the time keeping frequency with a precision of 1 part in (32,768×3600) or $3.05\times10^{-5}$ seconds per hour. Adjusting the first second of every hour by $3.05\times10^{-5}$ seconds translates into an adjustment of $7.32\times10^{-4}$ seconds per day. Therefore, the system could achieve a modification as small as $7.32\times10^{-4}$ seconds per day, which corresponds to an adjusting precision of better than one second per year. In this manner, the system could achieve a much greater cumulative accuracy than if the time keeping frequency were adjusted every second.

Finally, it is important to note that most users of electronic timepieces are not concerned that every individual second be precisely accurate, but rather are interested in cumulative accuracy and precision. Thus, users would appreciate a method which adjusted one second every adjustment interval as opposed to a method which adjusted each and every second.

SUMMARY OF THE INVENTION

The present invention is a method and apparatus for adjusting the accuracy of electronic timepieces. The apparatus comprises an electronic timepiece which includes an oscillator with a $2^n$ frequency output, means for reducing the oscillator output frequency to a time keeping frequency, means for counting the time keeping frequency, and means for displaying the time corresponding to the count of the time keeping frequency. The user initially synchronizes the timepiece with a time standard. The number of adjustment intervals, N, which have elapsed since the initial synchronization are counted. After some period of time, the user resynchronizes the timepiece with a time standard. At the moment of resynchronization, the error accumulated by the timepiece since the initial synchronization, E, is calculated. The value of E is divided by N to obtain an accuracy adjustment factor. Subsequently, at a specified time interval during each adjustment interval, the count of the time keeping frequency is adjusted by the amount of the accuracy adjustment factor.

Accordingly, it is a principal object of the present invention to provide methods for adjusting the accuracy of an electronic timepiece in an inexpensive manner.

Another object of the present invention is to provide methods for user adjustment of an electronic timepiece to compensate for accumulated error due to drift of the quartz crystal.

A further object of the present invention is to provide methods for enabling users to compensate for the drift of the quartz crystal continuously over the life of a timepiece.

Still another object of the invention is to provide methods for adjusting the accuracy of an electronic timepiece which reduce the need for periodic resynchronization of the timepiece with standard time references.

DETAILED DESCRIPTION OF THE INVENTION

Figure 1:
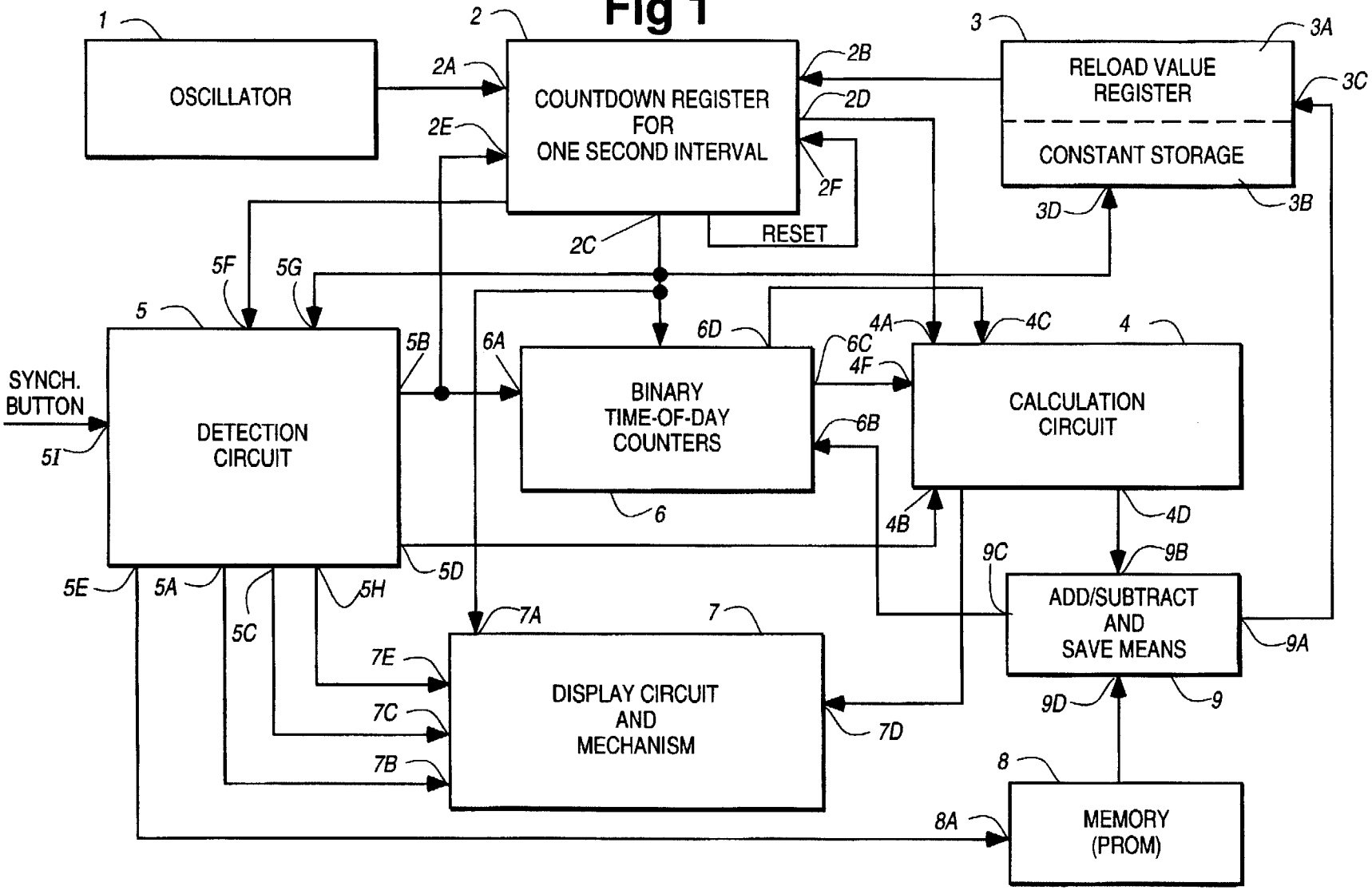
FIG. 1 is a schematic, block diagram of one embodiment of the invention.

In the embodiment of the invention shown in FIG. 1, an oscillator 1 with a $2^n$ frequency output, such as a quartz crystal oscillator, is used as a basis of time for an electronic timepiece. The electronic timepiece may be either digital or, as in the case of the present embodiment, analog-display-only. The quartz oscillator delivers pulses at a relatively high frequency, for example $2^{15}$ Hz, to the input of a circuit capable of reducing the oscillator output frequency to a lower time keeping frequency. Such a circuit might be comprised of frequency dividers or counters.

In the depicted embodiment, the oscillator output frequency is $2^{15}$ Hz and serves as an input 2A to a countdown register 2. The countdown register 2 has a second input 2B which receives a load value, corresponding to the oscillator output frequency, from the output of a reload circuit 3. The countdown register 2 reduces the oscillator output frequency to a time keeping frequency by counting each pulse provided by the oscillator 1 and emitting one pulse at an output 2C when countdown register 2 reaches zero. As countdown register 2 begins counting down from a load value equal to the oscillator output frequency, countdown register 2 emits one pulse every second through output 2C, which is a useful time keeping frequency of 1 Hz. Countdown register 2 has another output 2D which transmits the binary information corresponding to the register's current count to an input 4A of calculation circuit 4. Furthermore, countdown register 2 has a reset line 2F for reinitiating a count after zero has been reached in the previous countdown sequence.

Output 2C delivers the 1 Hz time keeping frequency to a circuit capable of counting the time keeping frequency, such as a circuit comprised of binary counters 6. In this embodiment, the binary time-of-day counters 6 track the elapsed seconds, minutes, and hours. The next step consists of displaying the time corresponding to the count of the time keeping frequency. As the present embodiment is analog-display-only, the 1 Hz output 2c is delivered to an input 7A of a display circuit and mechanism 7 which drives the seconds, minutes, and hours hands of the timepiece.

Once the timepiece is properly displaying the time, the ensuing step entails synchronizing the timepiece with a time standard to achieve an initial synchronization. In the present embodiment of the invention, the initial synchronization is a multi-step process. First, the user of the timepiece presses a synchronization button for a predetermined number of seconds, such as five seconds, at the instant the seconds hand is in the zero position. At input 5I, detection circuit 5 detects whether, and for how long, the synchronization button has been depressed. Second, simultaneously with detecting a depression of the synchronization button, the detection circuit sends an output signal 5A to input 7B of display circuit and mechanism 7 which freezes the display of time until the synchronization button is again pressed. In the method of the present embodiment, display circuit and mechanism 7 freezes the seconds hand at the instant it is in the zero position. Third, the user again presses the synchronization button, but momentarily this time (certainly, for less than five seconds), upon observing the time standard at zero seconds. Simultaneously with this second depression of the synchronization button, detection circuit 5 delivers four output signals.

The first output signal 5B is sent to an input 6A of the binary time-of-day counters 6 and resets the seconds counter. The second output signal 5C feeds an input 7C to the display circuit and mechanism 7, causing the display mechanism to release the seconds hand and resume displaying the time so as to synchronize the timepiece with the time standard. The third output signal 5D connects to input 4B of calculation circuit 4 and resets and enables counters 20 therein (FIG. 2) to begin counting hourly pulses from output 6D of binary time-of-day counters 6 which are received at input 4C of calculation circuit 4. Consequently, at any subsequent moment, the counters 20 contain the binary information corresponding to the number of hours elapsed since the previous synchronization. The fourth output signal 5E is connected to input 8A of a non-volatile memory means, such as permanent, programmable read-only memory (PROM) 8, whose function will be disclosed hereafter.

According to the invention, an initial accuracy adjustment factor is calculated at the time of manufacture and stored in non-volatile memory means, such as permanent, programmable read-only memory (PROM) 8. The initial accuracy adjustment factor represents the difference between an adjustment interval being measured and displayed by the timepiece, such as a one hour interval, and a corresponding ideal time period measured by a time standard. This difference exists because the actual quartz crystal operating frequency of the oscillator differs slightly from the desired design frequency of $2^n$ Hz. The initial accuracy adjustment factor is calculated in units of oscillator pulses per adjustment interval.

As an example, suppose the adjustment interval is one hour, and at the time of manufacture it is observed that a one hour interval measured and displayed by the timepiece is 0.25 seconds slower than the ideal one hour interval of a time standard. The initial accuracy adjustment factor is equal to the observed 0.25 seconds difference between the timepiece and a time standard. As the timepiece is slow, the length of each hour interval measured and displayed by the timepiece must be decreased by the amount of the initial accuracy adjustment factor in order to synchronize the timepiece with the time standard. Accordingly, the initial accuracy adjustment factor is a negative number when the timepiece is slow. If the timepiece were fast, the initial accuracy adjustment factor would necessarily be a positive number so as to increase the length of an hour interval measured by the timepiece in order to synchronize the timepiece with a time standard.

Continuing with the foregoing example, the timepiece is slow and the initial accuracy adjustment factor is equal to −0.25 seconds. To convert the initial accuracy adjustment factor into units of oscillator pulses per adjustment interval, the −0.25 seconds difference is multiplied by the oscillator output frequency, which is $2^{15}$ Hz (32,768 Hz) in the present embodiment. Thus, the initial accuracy adjustment factor in this example would be −8,192 pulses/hour.

In the embodiment of FIG. 1, the initial accuracy adjustment factor is added to the oscillator output frequency, and the resultant sum is stored in the permanent, programmable read-only memory (PROM) 8. As disclosed hereafter, this sum is used to adjust the time keeping frequency at a specified time interval during each adjustment interval so that the adjustment interval measured and displayed by the timepiece equals the corresponding ideal time interval of a time standard.

As previously discussed, countdown register 2 provides a time keeping frequency of 1 Hz at output 2C. Output 2C is coupled to reload circuit 3, to binary time-of-day counters 6, to display circuit and mechanism 7, and to detection circuit 5. Reload circuit 3 comprises a reload value register 3A and a constant storage portion 3B. Constant storage portion 3B stores the number corresponding to the ideal oscillator output frequency. Assuming an ideal quartz crystal oscillator frequency of $2^{15}$ Hz in this embodiment, the constant storage portion 3B stores the number 32,768. Add/Subtract and save means 9 has three inputs and an output 9A connected to input 3C of reload circuit 3. Input 9B comes from output 4D of calculation circuit 4, input 9C is connected to output 6B of binary time-of-day counters 6, and the third input 9D is provided by PROM 8.

In operation, countdown register 2 counts the output oscillator pulses corresponding to a one second interval. When countdown register 2 reaches zero, a reload value contained in reload value register 3A is loaded into countdown register 2, and countdown register 2 is reset to start a countdown from the loaded value. The 1 Hz output signal 2C is connected to input 3D of reload circuit 3 so as to cause the transfer of the stored constant 32,768 from constant storage 3B to reload value register 3A. In this manner, reload value register 3A usually contains the value 32,768 so that the value loaded into countdown register 2 generally corresponds to the ideal operating frequency of the quartz crystal oscillator 1.

In order to correct the error accumulated over an adjustment interval, binary time-of-day counters 6 send an output signal 6B to input 9C of add/subtract and save means 9 every adjustment interval. Assuming the adjustment interval is one hour in this embodiment, input 9C receives hourly pulses. In response to these hourly pulses, add/subtract and save means 9 sends its current value to input 3C of reload value register 3A. When this value is loaded into countdown register 2, the next second count is a modified one second interval which serves to adjust the length of the one hour adjustment interval measured and displayed by the timepiece so that it is exactly the duration of an ideal one hour period of a time standard.

As mentioned previously, PROM 8 contains the sum of the initial accuracy adjustment factor and the oscillator output frequency. PROM 8 receives an input signal 8A from detection circuit 5 the second time the synchronization button is depressed during an initial synchronization. Input signal 8A causes PROM 8 to transfer its value to add/subtract and save means 9 via output 9D. Initially, there is no preexisting value in add/subtract and save means 9, and calculation circuit 4 does not provide an input signal 9B until later resynchronizations. Thus, beginning immediately after the initial synchronization, add/subtract and save means 9 contains the PROM value. When add/subtract and save means 9 receives an hourly signal at input 9C from binary time-of-day counters 6, the PROM value in add/subtract and save means 9 is sent to the reload value register 3A. Thus, for the first second of every hour, the PROM value, which differs from 32,768 by the amount of the accuracy adjustment factor, becomes the reload value for countdown register 2. Accordingly, the subsequent modified second interval acts to adjust the length of the hour displayed by the timepiece so that it equals the ideal one hour period of a time standard. The PROM reload value is used only for the first second of every hour—the usual value of 32,768 replaces the PROM value at the next reload of countdown register 2.

The present invention maintains the accuracy of an electronic timepiece by performing adjustments to the time keeping frequency after some amount of error has accumulated. The adjustments are made once every adjustment interval, such as once every hour as described above. The adjustments based on the initial accuracy adjustment factor compensate for the discrepancy between the actual quartz crystal operating frequency and the desired design frequency of $2^n$ Hz. Over time, however, the quartz crystal will drift due to the aging of the crystal, temperature variations, and, in the case of wristwatches, wearing habits of the user. Thus, a method of fine-tuning the adjustments depending on the extent of crystal drift is desirable in order to continuously maintain the accuracy of the timepiece over its life.

According to the invention, this is accomplished through a small number of future resynchronizations whereby the timepiece is again synchronized with a time standard and increasingly precise correction increments to the adjustment factor are calculated. It is important to note that the resynchronizations serve dual functions: (1) resynchronizations compensate for the continual drift of the crystal, and (2) each resynchronization produces a further refined and more precise correction increment to the adjustment factor. Therefore, through resynchronizations the cumulative accuracy of the timepiece is both preserved and enhanced over long periods of time.

In the embodiment of FIG. 1, future resynchronizations are accomplished by depressing the synchronization button. As previously disclosed, upon the second depression of the synchronization button, which completed the initial synchronization, an output signal 5D was delivered to input 4B of calculation circuit 4. This signal enabled the binary counters 20 (FIG. 2) to begin counting the hourly pulses received at input 4C. Thus, counters 20 contain the binary information corresponding to the number of hours elapsed since the previous synchronization.

Upon observing an accumulated error of the timepiece (however large or small, but in no case greater than 30 seconds), the user realizes a resynchronization by momentarily pushing the synchronization button at the instant a time standard is in the zero seconds position. When the user pushes the synchronization button, the seconds hand of the timepiece is stopped. The user must press the synchronization button for less than five seconds, otherwise detection circuit 5 will respond as if the user desired an initial synchronization (i.e. the system will "re-boot" and the PROM value will be reloaded into add/subtract and save means 9). Detection circuit 5 contains means for calculating how long the user depressed the synchronization button. With the combination of input 5G, whole seconds elapsed, and input 5F, the current count of countdown register 2 corresponding to portions of seconds elapsed, detection circuit 5 determines the precise amount of time during which the synchronization button was depressed and the seconds hand stopped.

If the user holds down the synchronization button for a predetermined number of seconds, such as five seconds, detection circuit 5 re-boots the system. Specifically, output signal 5E is sent to input 8A of PROM 8, resulting in the clearing of the value in add/subtract and save means 9 and the reloading of the PROM value. Consequently, future adjustment intervals are again modified by the value of the initial accuracy adjustment factor.

In contrast, if the user depresses the synchronization button for less than five seconds, the timepiece is resynchronized with a time standard and a first correction increment, I, is calculated. The first correction increment compensates for the drift of the quartz crystal. In the present embodiment, the first correction increment is added to the PROM value currently in add/subtract and save means 9, and the resultant sum is then stored in add/subtract and save means 9. This resultant sum is transmitted to reload value register 3A at the first second of every hour and modifies the length of the first second so that one hour displayed and measured by the timepiece equals one hour of a time standard.

In further detail, the resynchronization of the timepiece and calculation of the first correction increment, I, are achieved as follows in the present embodiment. First, the user momentarily presses the synchronization button upon observing the time standard at zero seconds. Detection circuit 5 detects the depression of the synchronization button and sends output signal 5A to input 7B of display circuit and mechanism 7, thereby freezing the seconds hand. Simultaneously, output signal 5B is sent to input 6A of binary time-of-day counters 6, and to input 2E of countdown register 2. Upon its receipt at input 6A, output signal 5B causes the binary information for the current value of seconds to be delivered from output 6C to input 4F of calculation circuit 4. Output signal 5B then resets the seconds counter to zero in binary time-of-day counters 6. When output signal 5B is received at input 2E of countdown register 2, the bit pattern corresponding to the current count of countdown register 2 is read and then sent via output 2D to input 4A of calculation circuit 4.

Figure 2:
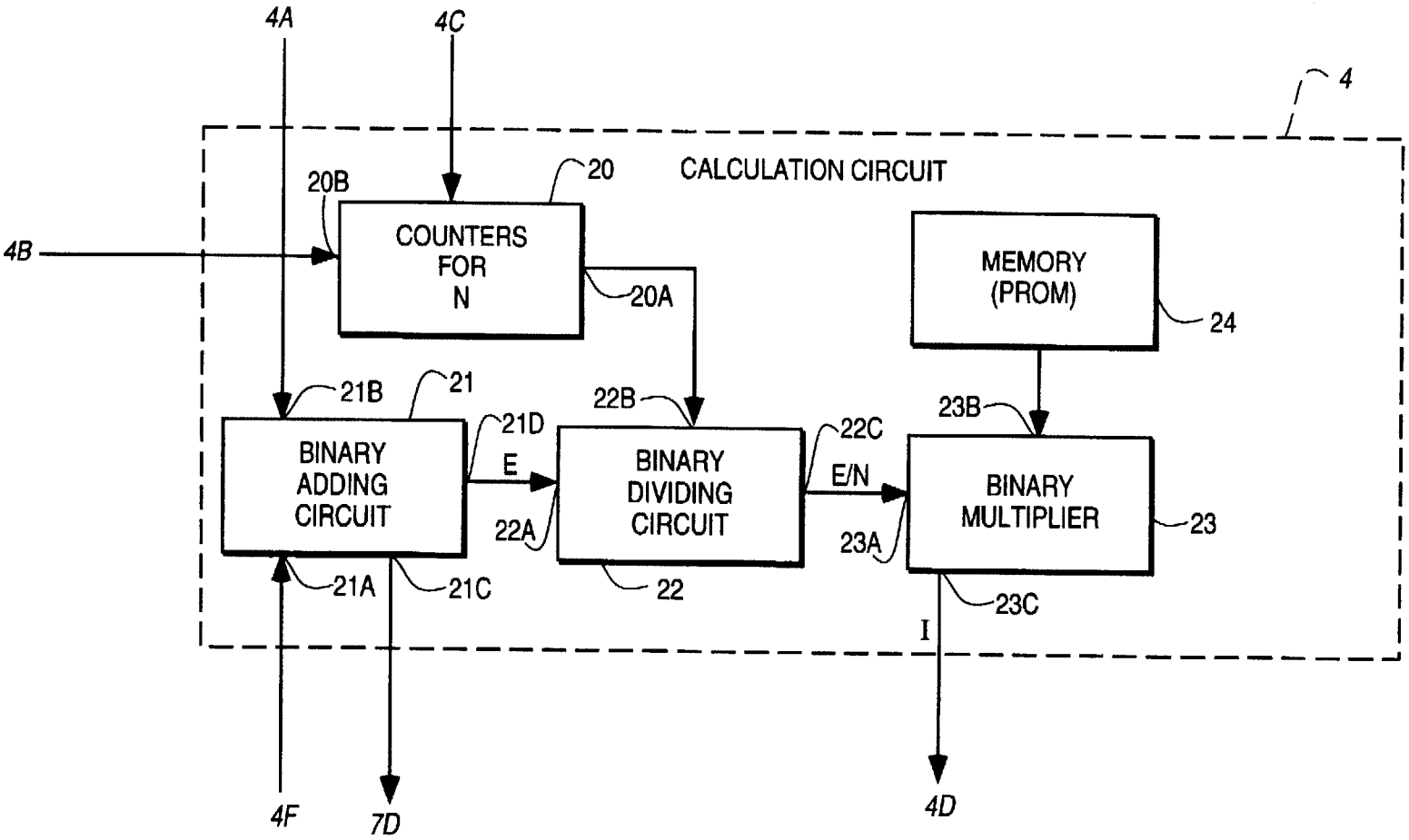
FIG. 2 is a simplified diagram of one embodiment of the calculation circuit of FIG. 1.

FIG. 2 shows one implementation of the calculation circuit 4. Calculation circuit 4 is comprised of a binary adding circuit 21, a binary dividing circuit 22, a binary multiplier 23, counters for N 20 (the number of adjustment intervals elapsed since the previous synchronization), and memory means 24.

During a resynchronization, input 4F delivers the value of seconds from binary counters 6 to binary adding circuit 21. Upon receipt of this seconds value at input 21A, binary adding circuit 21 reads the count of the countdown register at input 21B and converts it into binary information for the corresponding fraction of a second. Then, the seconds value received at input 21A is combined with the fraction of a second to produce a value for E.

Binary adding circuit 21 calculates the period of time |E| in such a manner that E represents the error accumulated by the timepiece since the initial synchronization of the timepiece. If the timepiece has become fast, E is a positive number, whereas if the timepiece has become slow, E is a negative number.

The accumulated error, E, is calculated under the reasonable assumption that the timepiece has not drifted more than 30 seconds, fast or slow, since the previous synchronization. If the seconds value read at input 21A is between 0 and 29, this means that the timepiece is fast, and the seconds value represents the number of seconds of gain. The value of E is a positive number and is equal to the sum of the seconds values at inputs 21A and 21B. On the other hand, if the seconds value is between 30 and 59, this means the timepiece is slow and the seconds value represents the complement to 60 of the number of seconds of loss. The value of E is a negative number and is equal to the negative of the complement to 60 of the sum of the seconds values at inputs 21A and 21B.

Regardless of whether the timepiece is fast or slow, the value of E is sent by output 21C to input 7D of display circuit and mechanism 7. Output 21D transmits the value of E to input 22A of the binary dividing circuit 22.

The binary dividing circuit 22 has another input 22B that is connected to output 20A of counters for N 20. When the user depresses the synchronization button for a resynchronization, output signal 5D of detection circuit 5 is received at input 20B of the counters for N 20, sending the current value of the counters 20 to input 22B of binary dividing circuit 22 and resetting the counters 20 to zero. Once binary dividing circuit 22 has received values for both E and N, the circuit performs the division and sends the resulting quotient E/N via output 22C to input 23A of binary multiplier 23. The quotient E/N represents the error that accumulates in the timepiece, and which needs to be compensated for accordingly, in units of seconds per adjustment interval.

Binary multiplier 23 has an input 23B that receives the value of constant C, the oscillator output frequency, from a memory means. In the embodiment of FIG. 2, the memory means is permanent, programmable read-only memory (PROM) 24. Upon receipt of the quotient E/N at input 23A, binary multiplier 23 multiplies E/N by C to obtain a first correction increment, I. The first correction increment, I, represents a correction amount, in addition to the initial accuracy adjustment factor, by which the timepiece needs to be adjusted to compensate for the drift of the quartz crystal. The first correction increment, I, is in units of oscillator pulses per adjustment interval.

Output 23C of binary multiplier 23 carries the value of the first correction increment, I, from calculation circuit 4 to add/subtract and save means 9 (FIG. 1). There, the value of I is added to the value currently saved in add/subtract and save means 9, which is initially the reload value of 32,768 from PROM 8. The sum of 32,768 and the value of I then replaces 32,768 as the saved value in add/subtract and save means 9. Upon receipt of hourly signals at input 9C, add/subtract and save means 9 sends its new saved value to reload value register 3A. Thus, the subsequent modified second interval accurately adjusts the length of the hour displayed by the timepiece, compensating for the drift of the quartz crystal. In this manner, the cumulative accuracy of the timepiece is maintained.

The calculations and adjustments disclosed above operate to maintain the accuracy of the binary time-of-day counters 6. However, in the present embodiment, the seconds hand must also be adjusted so that the displayed time mirrors the binary time-of-day counters 6.

As previously disclosed, the depression of the synchronization button sends a signal to input 7B of display circuit and mechanism 7 which freezes the seconds hand. By means of inputs 5F and 5G from countdown register 2, detection circuit 5 calculates how long the user depressed the synchronization button, thereby stopping the seconds hand for the same period, during resynchronization. This information is sent from output 5H to input 7E of display circuit and mechanism 7. By combining this information with the value of E received at input 7D, display circuit and mechanism 7 calculates the amount by which the displayed time of the seconds hand differs from the newly reset seconds values of the binary counters (i.e., the value of zero to which the seconds counter was reset by input signal 6A immediately after the user pressed the synchronization button). Immediately upon the release of the synchronization button, display circuit and mechanism 7 resumes the motion of the seconds hand and, depending upon the sign and magnitude of the calculated time difference, either slows down or speeds up the seconds hand by the appropriate amount, thus synchronizing the displayed time values with the internally kept time-of-day values of binary counters 6.

According to the embodiment of FIGS. 1 and 2, future correction increments for the value saved in add/subtract and save means 9 may be calculated by resynchronizing the timepiece as disclosed above. By periodically resynchronizing the timepiece when a discernible error has accumulated, the user can update the value saved in add/subtract and save means 9, thereby continuously compensating for the drift of the quartz crystal. By this method, the user may easily adjust, maintain, and improve the cumulative accuracy of the timepiece over its life.

In a second embodiment of the invention, not illustrated in FIGS. 1 and 2, an initial synchronization is effected as disclosed above. Similarly, the factory-determined value stored in memory means, such as PROM, that is equal to the sum of the oscillator output frequency and the initial accuracy adjustment factor, adjusts the first second of every hour as measured by the binary time-of-day counters 6. However, instead of modifying this value by conducting future resynchronizations and calculating correction increments, this factory-determined stored value remains constant and always adjusts the same specified time interval of each adjustment interval, such as the first second of every hour. Rather, the correction increments that are calculated during resynchronizations are used to adjust a second specified time interval during subsequent adjustment intervals.

For example, assume the first correction increment, I, calculated during the first resynchronization, adjusts the first second following the ten-minute mark of every hour as measured by the binary time-of-day counters 6. Thus, the factory-stored value adjusts the first second at the top of every hour, while the first correction increment, I, adjusts the first second following the internally kept ten-minute mark of every hour. By the combination of these adjustments, each hour displayed by the timepiece is adjusted so that it equals an ideal hour of a time standard.

Some period of time after the first resynchronization, however, the timepiece will again accumulate an error due to continued drift of the quartz crystal. To compensate for this error, the user should again resynchronize the timepiece, calculating a second correction increment, J, in the same way the first correction increment was calculated. Then, by adjusting the first correction increment, I, by the amount of the second correction increment, J, the timepiece would determine a new correction increment, K. The value of this new correction increment, K, would subsequently be used to adjust the first second following the internally kept ten-minute mark of every hour.

However, over time, the timepiece will most likely begin to accumulate another error due to further crystal drift. To offset this drift, the value for the new correction increment, K, must be modified accordingly. By resynchronizing the timepiece, a correction factor for K may be calculated in the same way the first and second correction increments were calculated. Then, by adjusting K by the amount of the correction factor, an updated value for K may be obtained which compensates for the drift of the crystal since the previous resynchronization. The use of the updated value of K to adjust the first second following the internally kept ten-minute mark of every hour will both maintain and improve the accuracy of the timepiece.

To ensure the accuracy of the timepiece over its entire life, the timepiece may be periodically resynchronized according to the method disclosed above. In this way, additional correction factors will be calculated and added to the value of K, thereby continually updating the value of K to correct for the drift of the crystal. Even in the absence of further crystal drift, periodic resynchronizations will serve to improve the accuracy of the timepiece by calculating increasingly refined correction increments.

In a third embodiment of the invention, the timepiece selects an appropriate adjustment interval for the correction increments from a plurality of potential adjustment intervals. This feature only applies to selecting the adjustment interval that will be modified by the correction increments calculated during resynchronizations; the length of the adjustment interval that is modified by the factory-stored value must remain constant—i.e., the length contemplated by the timepiece manufacturer when the factory value was determined, such as one hour.

In this embodiment, the factory-stored value adjusts a specified time interval of a fixed adjustment interval, such as the first second of every hour. As in the previously described embodiments, the user may compensate for crystal drift by resynchronizing the timepiece. In this embodiment, however, the calculation of correction increments is somewhat different. The timepiece is designed so that it counts the time elapsed since the previous synchronization. During a resynchronization, the timepiece determines the accumulated error, E, and divides it by the number of hours elapsed since the previous synchronization. This quotient (in units of seconds/hour) is then multiplied by the oscillator output frequency to yield a value with units of oscillator pulses/hour. Depending upon the magnitude of this value, the timepiece selects an appropriate adjustment interval. For example, if the value is such that an adjustment may easily be made every hour (i.e., the value is not too small—certainly not less than one oscillator pulse/hour), then an adjustment interval of one hour might be selected. In such a case, the calculated value would become the correction increment used to adjust the timekeeping frequency at a second specified time interval of each hour.

However, if the calculated value (in units of oscillator pulses/hour) was very small, or less than one, a longer adjustment interval would be selected so that the adjustment could more easily be accomplished. For instance, assume that the calculated value was 0.5 oscillator pulses/hour. This value is too small to be implemented if the adjustment interval were one hour. Selecting a longer adjustment interval, though, results in a greater correction increment which could be implemented notwithstanding the limited inherent precision of the timepiece. For example, if an adjustment interval of 12 hours was selected, the resultant correction increment would be 6 oscillator pulses/12 hours. Accordingly, every 12 hours, at the second specified time interval, the timepiece would modify one second by 6 oscillator pulses, thereby maintaining the cumulative accuracy of the timepiece. Thus, an advantage of this embodiment is that it allows the timepiece to extend the length of the adjustment intervals so that a greater precision may be achieved.

Alternatively, there might be situations where the calculated value is sufficiently large that adjustment intervals of less than one hour would be desirable. For example, consider the situation where the calculated value is sufficiently large that the modified second interval would be readily perceptible to the user were an adjustment interval of one hour selected. By choosing an adjustment interval of ten minutes, the resultant correction increment would be one-sixth the calculated value, and the cumulative accuracy of the timepiece could be maintained without creating a modified second interval that is readily apparent to the user.

Thus, the advantage of this embodiment is that it allows the timepiece to select an adjustment interval of appropriate length according to the degree of precision required and user perception of the occurrence of the adjustment. Depending upon how a timepiece was manufactured, it could have the capability of selecting from a plurality of adjustment intervals of diverse lengths. For example, a timepiece might be designed so that it could choose an adjustment interval from a choice of one, six, twelve, and twenty-four hour intervals. The ultimate choice would depend upon the magnitude of the calculated value (oscillator pulses/hour) and the correction increment that would result were a particular adjustment interval chosen.

In still another embodiment of the invention, the factory-determined adjustment value is applied at a plurality of specified time intervals during each adjustment interval. In this embodiment, future correction increments calculated during resynchronizations would be implemented at one specified time interval during each adjustment interval, while the factory value adjustments would occur at a plurality of specified time intervals. For example, a factory adjustment value might be applied to five different time intervals during a one hour adjustment interval. The factory adjustment value would be divided into five equal, smaller values to be applied at five distinct time intervals during each hour, such as the first second following the internally kept ten, twenty, thirty, forty, and fifty-minute marks. The correction increments calculated during resynchronizations would adjust another specified time interval of the one hour adjustment interval, such as the first second of every hour. The advantage of this method is that a potentially large factory-determined adjustment value might be implemented in such a fashion that the modified second intervals would be unnoticeable to the user.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A method for maintaining and adjusting the accuracy of an electronic timepiece that includes an oscillator with a $2^n$ frequency output, comprising the steps of:

(1) reducing the oscillator output frequency to a time keeping frequency;

(2) counting the time keeping frequency;

(3) displaying the time corresponding to the count of the time keeping frequency;

(4) selecting an adjustment interval, said adjustment interval corresponding to a time period being measured by the timepiece;

(5) calculating an initial accuracy adjustment factor at the time of manufacture of the electronic timepiece, said factor corresponding to the difference between the adjustment interval being measured by said timepiece and an ideal time period;

(6) adjusting the time keeping frequency at a first specified time interval during each adjustment interval by the amount of the initial accuracy adjustment factor;

(7) synchronizing the timepiece with a time standard to effect an initial synchronization, said synchronization initiated by a user of the timepiece;

(8) counting the number of adjustment intervals, N, elapsed since the previous synchronizing of the timepiece;

(9) resynchronizing the timepiece with a time standard, said resynchronizing initiated by a user of the timepiece;

(10) calculating the error, E, accumulated by the timepiece since the previous synchronizing of the timepiece;

(11) dividing the accumulated error by the number of adjustment intervals elapsed since the previous synchronizing of the timepiece to obtain the quotient E/N;

(12) multiplying the quotient E/N by a constant C, equal to the oscillator output frequency, to obtain a first correction increment, I, for the accuracy adjustment factor;

(13) adjusting the accuracy adjustment factor by the amount of the first correction increment, I, to obtain a new value for the accuracy adjustment factor; and

(14) adjusting the time keeping frequency at the first specified time interval during each subsequent adjustment interval by the amount of the new accuracy adjustment factor.

2. The method as claimed in claim 1 further comprising the step of periodically repeating steps (8) through (14) until a desired accuracy is achieved.

3. The method as claimed in claim 1 wherein the first adjustment interval is one hour and the first specified time interval is the first second of every hour.

4. The method as claimed in claim 1 wherein the initial accuracy adjustment factor is stored in non-volatile memory means.

5. The method as claimed in claim 4 wherein the initial accuracy adjustment factor is retrieved from the non-volatile memory means and placed in active memory.

6. The method as claimed in claim 4 wherein the non-volatile memory means is permanent, programmable read-only memory (PROM).

7. The method as claimed in claim 1 wherein said step for synchronizing the timepiece to effect an initial synchronization comprises the steps of:

(1) pressing a synchronization button initially for a predetermined number of seconds, said initial pressing initiated by a user of the timepiece;

(2) freezing the display of the time at the moment the synchronization button was initially pressed;

(3) pressing the synchronization button, said pressing initiated by a user of the timepiece;

(4) setting the count of the time keeping frequency so as to agree with the time standard; and (5) resuming the display of the time corresponding to the count of the time keeping frequency at the moment the synchronization button is momentarily pressed so as to synchronize the timepiece with the time standard.

8. The method as claimed in claim 7 wherein said predetermined number of seconds is five seconds.

9. The method as claimed in claim 7 wherein the timepiece displays the hours, minutes, and seconds corresponding to the count of the time keeping frequency, and the synchronization button is initially pressed in for the predetermined number of seconds at the instant the displayed seconds is in the zero position.

10. The method as claimed in claim 9 wherein the timepiece is an analog-display-only watch or clock with second, minute and hour hands, and the second hand is stopped when the synchronization button is initially pressed and started again when the synchronization button is momentarily pressed upon observing the time standard at zero seconds.

11. The method as claimed in claim 7 wherein the timepiece may be re-booted and the initial accuracy adjustment factor restored by repeating the steps of claim 7.

12. A method for maintaining and adjusting the accuracy of an electronic timepiece that includes an oscillator with a $2^n$ frequency output, comprising the steps of:

(1) reducing the oscillator output frequency to a time keeping frequency;

(2) counting the time keeping frequency;

(3) displaying the time corresponding to the count of the time keeping frequency;

(4) selecting an adjustment interval, said adjustment interval corresponding to a time period being measured by the timepiece;

(5) calculating an initial accuracy adjustment factor at the time of manufacture of the electronic timepiece, said factor corresponding to the difference between the adjustment interval being measured by said timepiece and an ideal time period;

(6) adjusting the time keeping frequency at a first specified time interval during each adjustment interval by the amount of the initial accuracy adjustment factor;

(7) synchronizing the timepiece with a time standard to effect an initial synchronization, said synchronization initiated by a user of the timepiece;

(8) counting the number of adjustment intervals, N, elapsed since the previous synchronizing of the timepiece;

(9) resynchronizing the timepiece with a time standard, said resynchronizing initiated by a user of the timepiece;

(10) calculating the error, E, accumulated by the timepiece since the previous synchronizing of the timepiece;

(11) dividing the accumulated error by the number of adjustment intervals elapsed since the previous synchronizing of the timepiece to obtain the quotient E/N;

(12) multiplying the quotient E/N by a constant C, equal to the oscillator output frequency, to obtain a first correction increment, I; and

(13) adjusting the time keeping frequency at a second specified time interval during each subsequent adjustment interval by the amount of the first correction increment, I.

13. The method as claimed in claim 12 further comprising the steps of:

(1) counting the number of adjustment intervals, N, elapsed since the previous synchronizing of the timepiece;

(2) resynchronizing the timepiece with a time standard, said resynchronizing initiated by a user of the timepiece;

(3) calculating the error, E, accumulated by the timepiece since the previous synchronizing of the timepiece;

(4) dividing the accumulated error by the number of adjustment intervals elapsed since the previous synchronizing of the timepiece to obtain the quotient E/N;

(5) multiplying the quotient E/N by the constant C to obtain a second correction increment, J;

(6) adjusting the first correction increment, I, by the amount of the second correction increment J, to obtain a new correction increment, K; and (7) adjusting the time keeping frequency at the second specified time interval during each subsequent adjustment interval by the amount of the new correction increment, K.

14. The method as claimed in claim 13 further comprising the steps of:

(1) counting the number of adjustment intervals, N, elapsed since the previous synchronizing of the timepiece;

(2) resynchronizing the timepiece with a time standard, said resynchronizing initiated by a user of the timepiece;

(3) calculating the error, E, accumulated by the timepiece since the previous synchronizing of the timepiece;

(4) dividing the accumulated error by the number of adjustment intervals elapsed since the previous synchronizing of the timepiece to obtain the quotient E/N;

(5) multiplying the quotient E/N by the constant C to obtain a correction factor;

(6) adjusting the new correction increment, K, by the amount of the correction factor to obtain an updated value for K;

(7) adjusting the time keeping frequency at the second specified time interval during each subsequent adjustment interval by the amount of the updated value for K; and (8) periodically repeating steps (1) through (7) until a desired accuracy is achieved.

15. The method as claimed in claim 12 wherein the adjustment interval for steps (8) through (13) is selected from a plurality of adjustment intervals of diverse lengths, the selection depending upon the magnitude of the accumulated error, the time elapsed since the previous synchronization, and the resultant first correction increment.

* * * * *